US005974713A

United States Patent [19]

Wu

[11] Patent Number: 5,974,713

[45] Date of Patent: Nov. 2, 1999

[54] PICTURE FRAME ASSEMBLY

[76] Inventor: Shiang-Lan Wu, 58, Ma Yuan West St., Taichung, Taiwan

[21] Appl. No.: 09/102,338

[22] Filed: Jun. 22, 1998

[51] Int. Cl.[6] ..... A47G 1/06

[52] U.S. Cl. ..... 40/733; 40/605

[58] Field of Search ..... 40/730, 733, 605; 403/91, 92, 93, 96; 16/257, 262

[56] References Cited

U.S. PATENT DOCUMENTS

| | | | |
|---|---|---|---|
| 715,376 | 12/1902 | Harper | 40/733 |
| 2,345,719 | 4/1944 | Weil, Jr. | 40/733 |
| 2,732,581 | 1/1956 | Heck . | |
| 3,102,609 | 9/1963 | Gerard | 403/93 X |
| 4,214,392 | 7/1980 | Virsen | 40/733 X |
| 4,226,037 | 10/1980 | Rodriguez | 40/733 |
| 4,562,656 | 1/1986 | Kristofich | 40/733 |
| 4,785,565 | 11/1988 | Kuffner | 40/605 |

*Primary Examiner*—Joanne Silbermann

[57] ABSTRACT

A picture frame assembly has a first picture frame and a second picture frame. The first picture frame has a first connection bar, a first insert rod disposed on the first connection bar, a first connection plate, and a first C-shaped clamp plate disposed on the first connection plate. The second picture frame has a second connection bar, a second insert rod disposed on the second connection bar, a second connection plate, and a second C-shaped clamp plate disposed on the second connection plate. The second insert rod is inserted in the first C-shaped clamp plate.

4 Claims, 10 Drawing Sheets

PICTURE FRAME ASSEMBLY

BACKGROUND OF THE INVENTION

The present invention relates to a picture frame assembly. More particularly, the present invention relates to a picture frame assembly which comprises a plurality of picture frames.

A conventional picture frame can display a picture. Two conventional picture frames can be fastened by a fastener. Once two conventional picture frames are assembled to become a picture frame assembly, it is difficult to detach the picture frame assembly.

SUMMARY OF THE INVENTION

An object of the present invention is to provide a picture frame assembly which is easily detached.

Another object of the present invention is to provide a picture frame assembly which can be arranged in different ways.

In accordance with a first preferred embodiment, a picture frame assembly comprises a first picture frame and a second picture frame. The first picture frame has a first connection bar disposed on a first lateral of the first picture frame, a first insert rod disposed on the first connection bar, a first connection plate disposed on a second lateral of the first picture frame, and a first C-shaped clamp plate disposed on the first connection plate. The second picture frame has a second connection bar disposed on a first lateral of the second picture frame, a second insert rod disposed on the second connection bar, a second connection plate disposed on a second lateral of the second picture frame, and a second C-shaped clamp plate disposed on the second connection plate. The second insert rod of the second picture frame is inserted in the first C-shaped clamp plate of the first picture frame.

In accordance with a second preferred embodiment, a picture frame assembly comprises a first picture frame and a second picture frame. The first picture frame has a first connection bar disposed on a bottom portion of the first picture frame, a first insert rod disposed on the first connection bar, a first connection plate disposed on a top portion of the first picture frame, and a first C-shaped clamp plate disposed on the first connection plate. The second picture frame has a second connection bar disposed on a bottom portion of the second picture frame, a second insert rod disposed on the second connection bar, a second connection plate disposed on a top portion of the second picture frame, and a second C-shaped clamp plate disposed on the second connection plate. The first insert rod of the first picture frame is inserted in the second C-shaped clamp plate of the second picture frame.

DETAILED DESCRIPTION OF THE INVENTION

Figure 1:
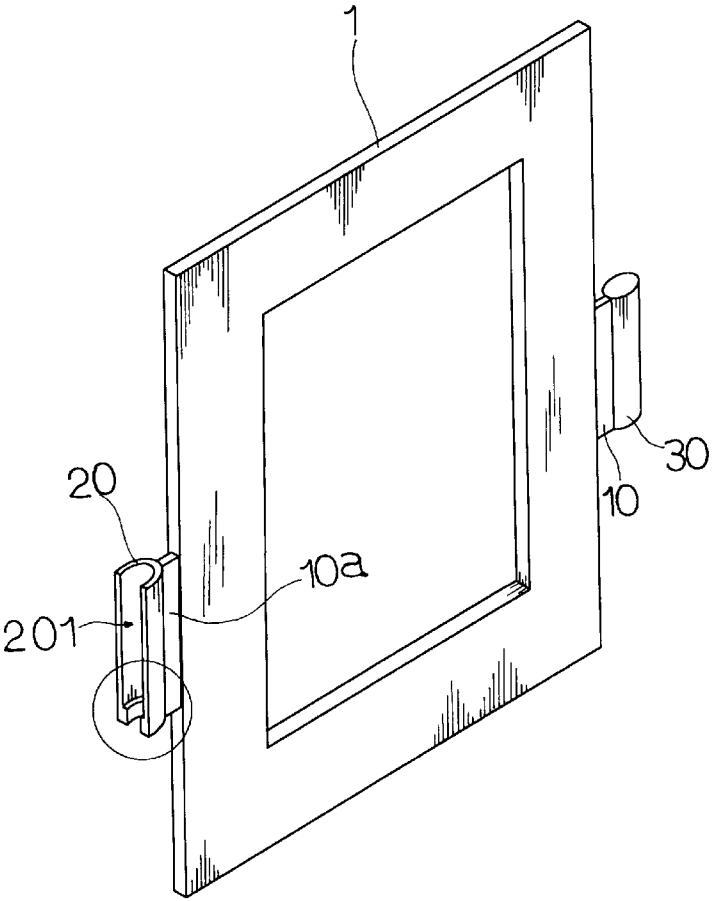
FIG. 1 is a perspective view of a picture frame of a first preferred embodiment in accordance with the present invention.
Figure 1A:
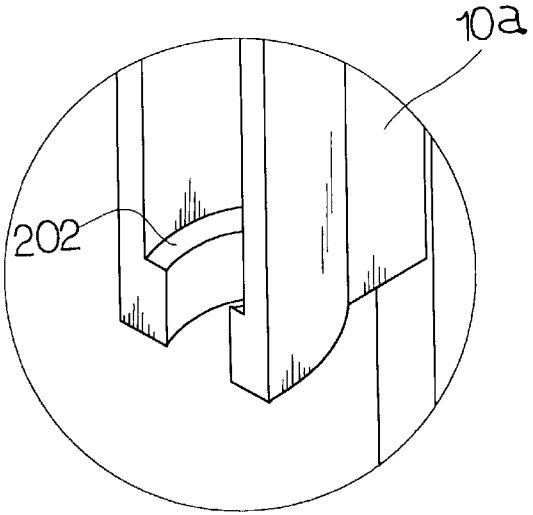
FIG. 1A is an enlarged view of a lower portion of a clamp plate of a first preferred embodiment in accordance with the present invention.
Figure 2:
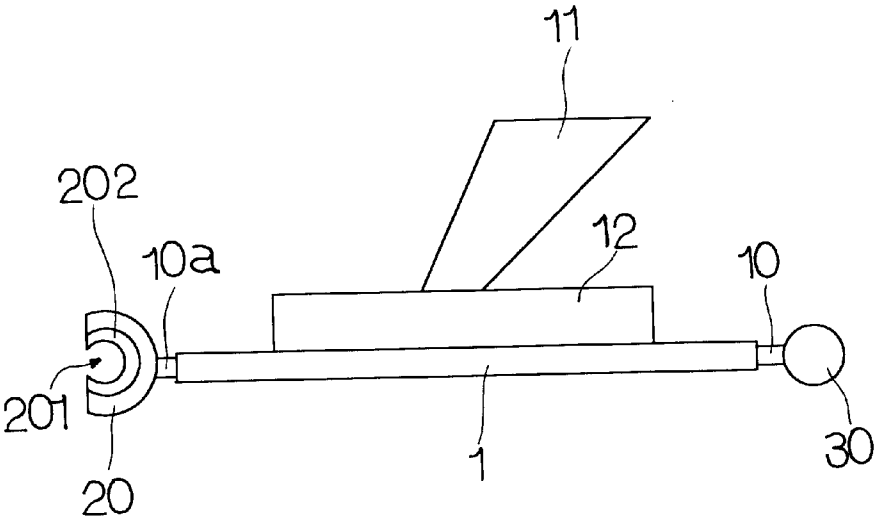
FIG. 2 is a top plan view of FIG. 1.

Referring to FIGS. 1, 1A, and 2, a picture frame 1 comprises a back plate 12 disposed on a back of the picture frame 1, a support plate 11 connected to the back plate 12, a connection bar 10 disposed on a first lateral of the picture frame 1, an insert rod 30 disposed on the connection bar 10, a connection plate 10*a* disposed on a second lateral of the picture frame 1, and a C-shaped clamp plate 20 disposed on the connection plate 10*a*. The clamp plate 20 has a channel 201 and a C-shaped inner flange 202.

Figure 5:
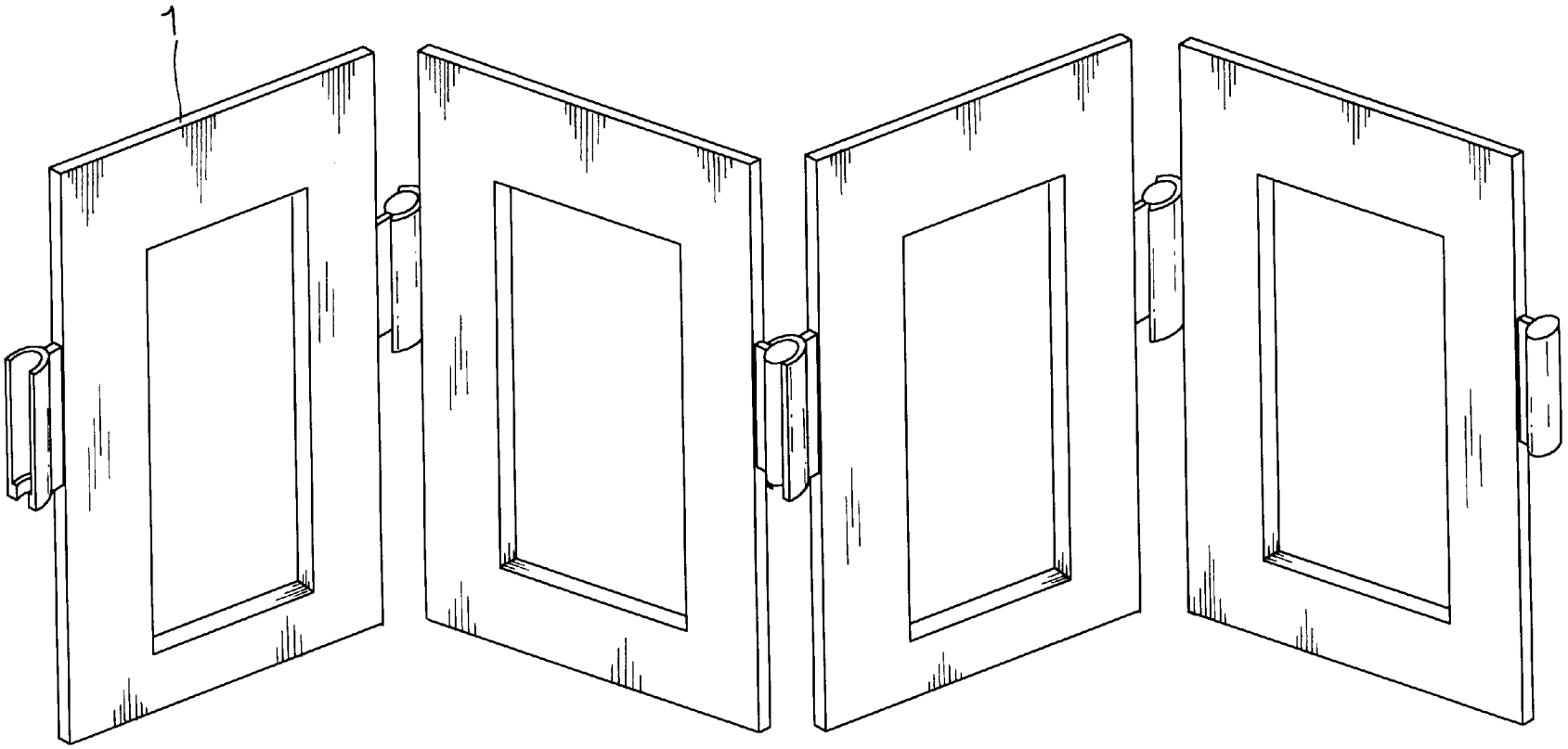
FIG. 5 is a schematic view illustrating a first arrangement of a plurality of picture frames.

Referring to FIG. 5, a plurality of picture frames 1 are arranged in series.

Figure 4B:
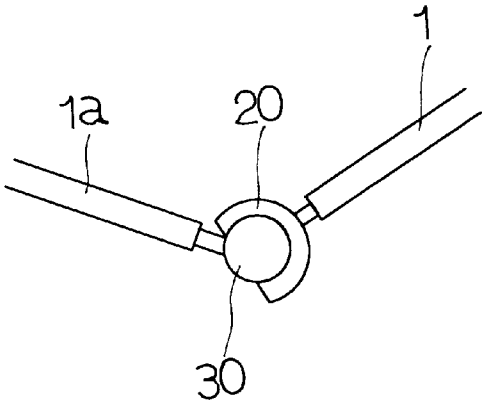
FIG. 4B is another schematic view illustrating an operation of a picture frame assembly of a first preferred embodiment in accordance with the present invention.
Figure 4A:
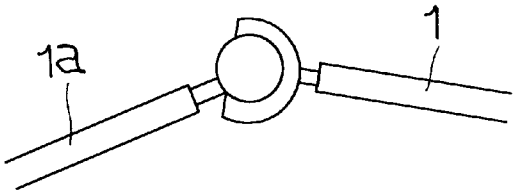
FIG. 4A is a schematic view illustrating an operation of a picture frame assembly of a first preferred embodiment in accordance with the present invention.
Figure 3:
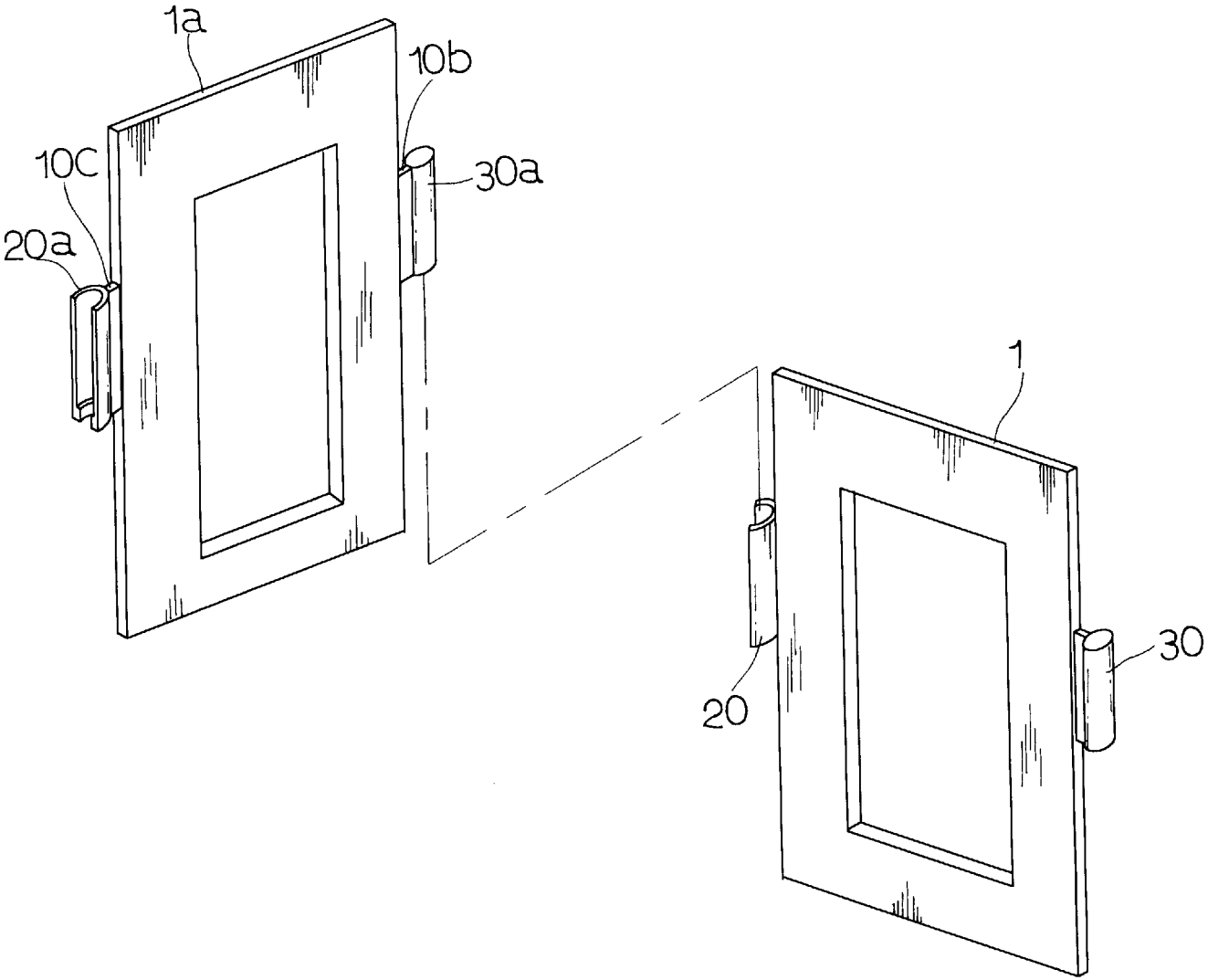
FIG. 3 is a perspective exploded view of a picture frame assembly of a first preferred embodiment in accordance with the present invention.
Figure 4:
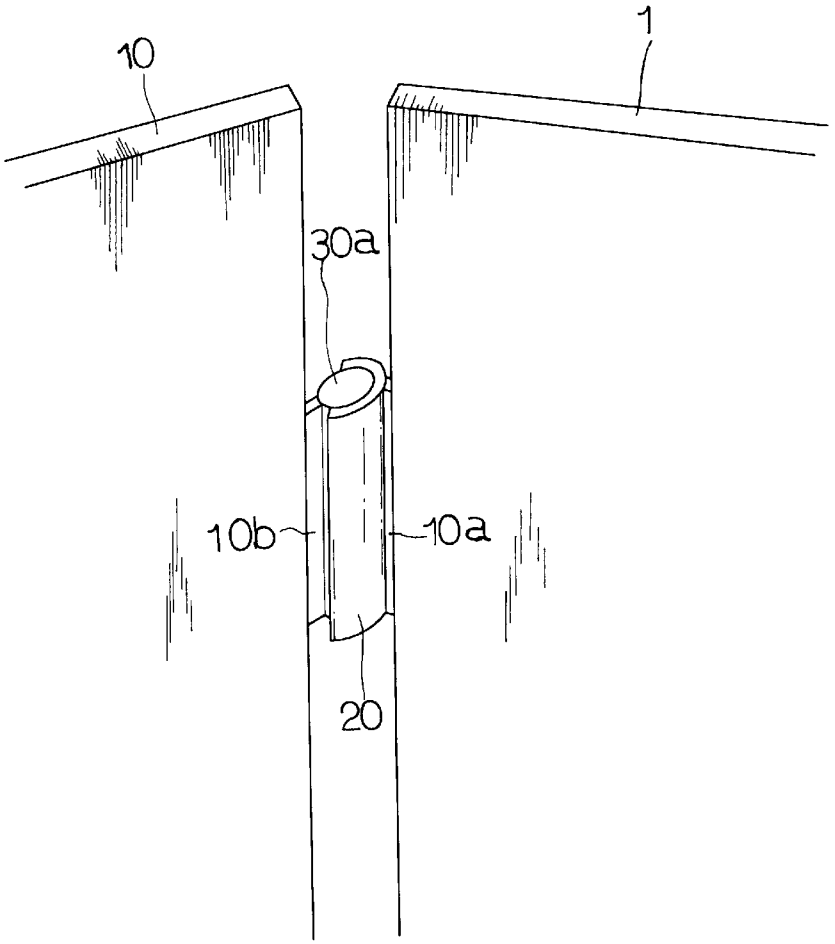
FIG. 4 is a partially perspective assembly view of a picture frame assembly of a first preferred embodiment in accordance with the present invention.

Referring to FIGS. 3 to 4B, a picture frame assembly comprises a first picture frame 1 and a second picture frame 1*a*. The first picture frame 1 has a first connection bar 10 disposed on a first lateral of the first picture frame 1, a first insert rod 30 disposed on the first connection bar 10, a first connection plate 10*a* disposed on a second lateral of the first picture frame 1, and a first C-shaped clamp plate 20 disposed on the first connection plate 10*a*. The second picture frame 1*a* has a second connection bar 10*b* disposed on a first lateral of the second picture frame 1*a*, a second insert rod 30*a* disposed on the second connection bar 10*b*, a second connection plate 10*c* disposed on a second lateral of the second picture frame 1*a*, and a second C-shaped clamp plate 20*a* disposed on the second connection plate 10*c*. The second insert rod 30*a* of the second picture frame 1a is inserted in the first C-shaped clamp plate 20 of the first picture frame 1.

Referring to FIGS. 4, 4A, and 4B, the second insert rod 30*a* of the second picture frame 1*a* can be rotated in the first C-shaped clamp plate 20 of the first picture frame 1.

Figure 5A:
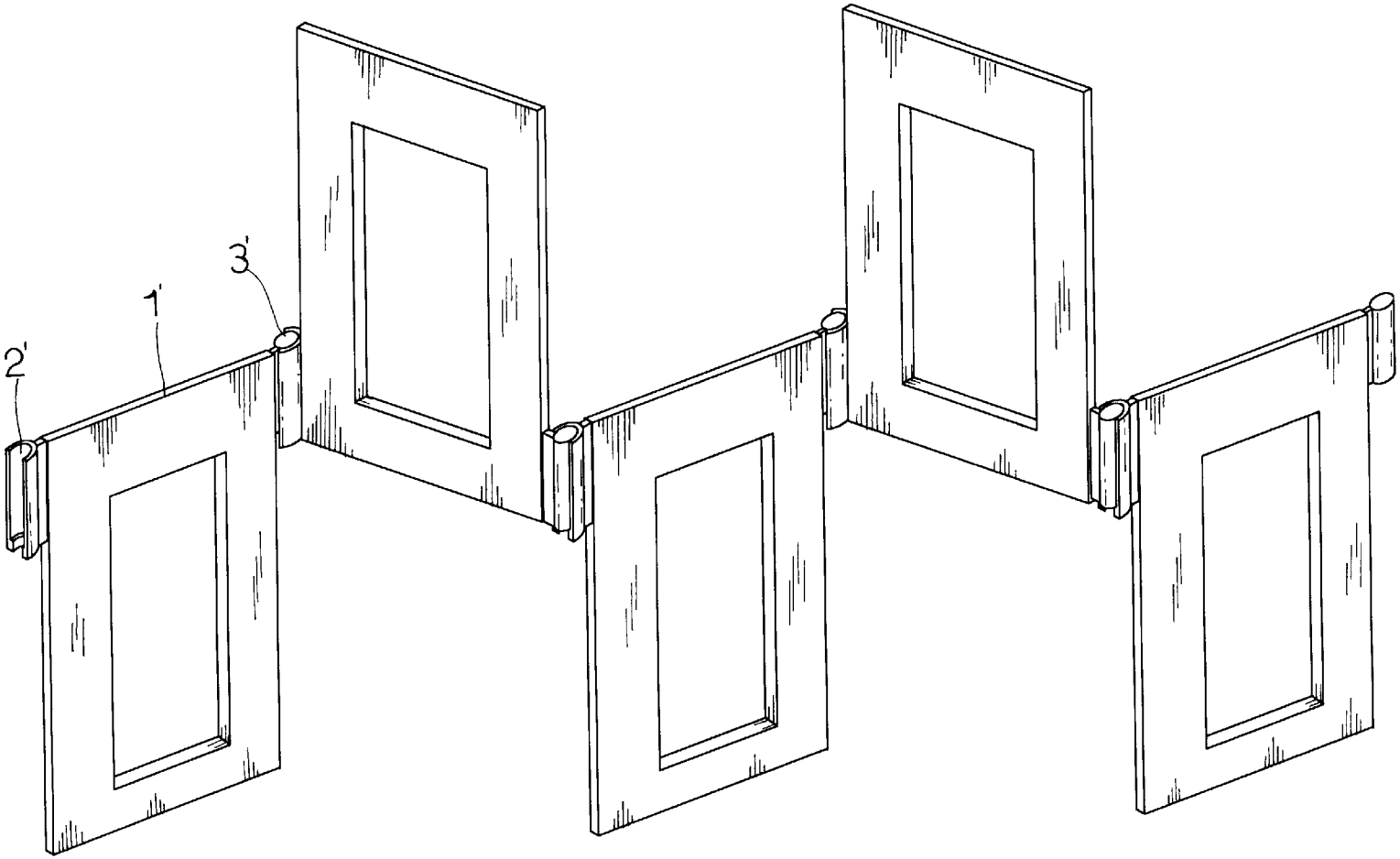
FIG. 5A is a schematic view illustrating a second arrangement of a plurality of picture frames.

Referring to FIG. 5A, a plurality of picture frames 1' are assembled together. Each picture frame 1' has an insert rod 3' and a C-shaped clamp plate 2'.

Figure 5B:
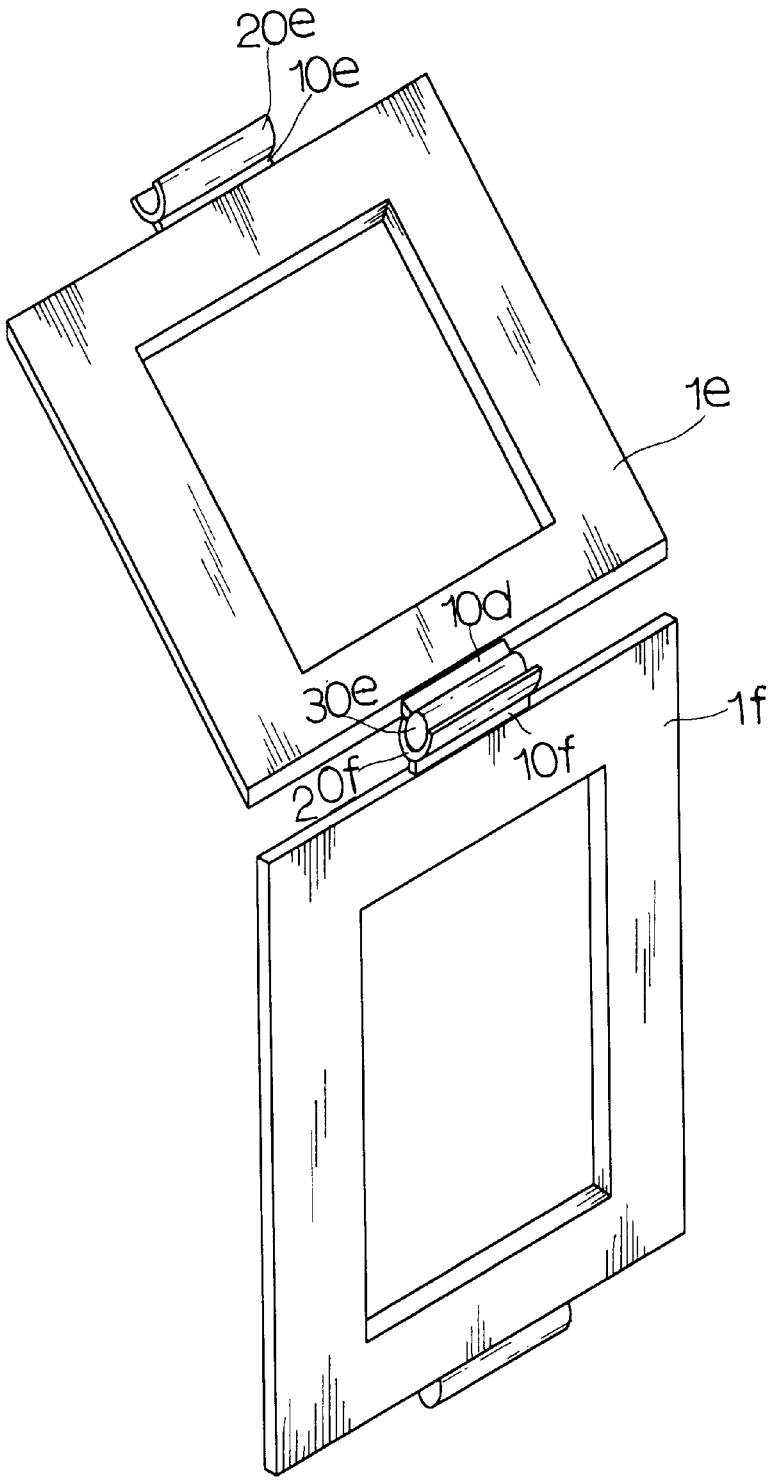
FIG. 5B is a schematic view illustrating an arrangement of two picture frames.

Referring to FIG. 5B, another picture frame assembly comprises a first picture frame 1*e* and a second picture frame 1*f*. The first picture frame 1*e* has a first connection bar 10*d* disposed on a bottom portion of the first picture frame 1*e*, a first insert rod 30*e* disposed on the first connection bar 10*d*, a first connection plate 10*e* disposed on a top portion of the first picture frame 1*e*, and a first C-shaped clamp plate 20*e* disposed on the first connection plate 10*e*. The second picture frame 1*f* has a second connection bar disposed on a bottom portion of the second picture frame 1*f*, a second insert rod disposed on the second connection bar, a second connection plate 10*f* disposed on a top portion of the second picture frame 1*f*, and a second C-shaped clamp plate 20*f* disposed on the second connection plate 10*f*. The first insert rod 30*e* of the first picture frame 1*e* is inserted in the second C-shaped clamp plate 20*f* of the second picture frame 1*f*.

Figure 5C:
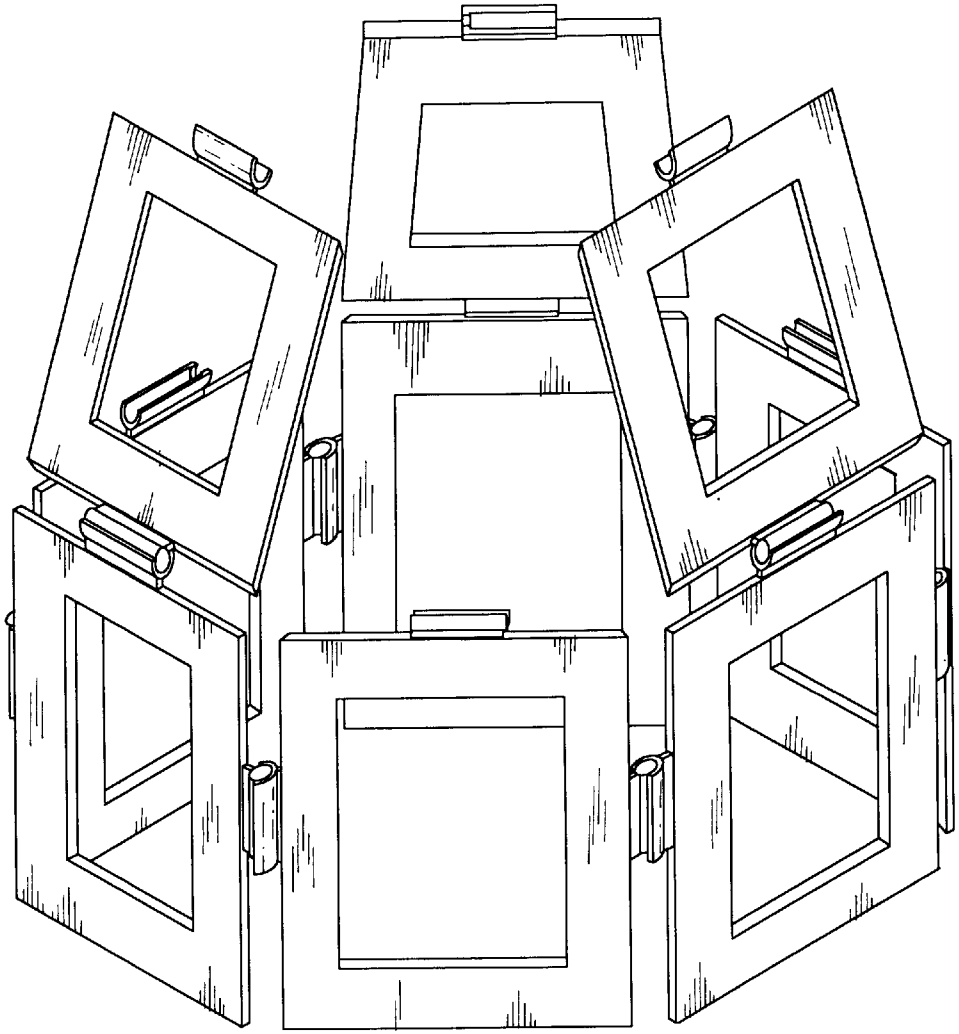
FIG. 5C is a schematic view illustrating a third arrangement of a plurality of picture frames.

Referring to FIG. 5C, a plurality of picture frames are assembled together. Each picture frame has at least an insert rod and at least a C-shaped clamp plate.

Figure 6:
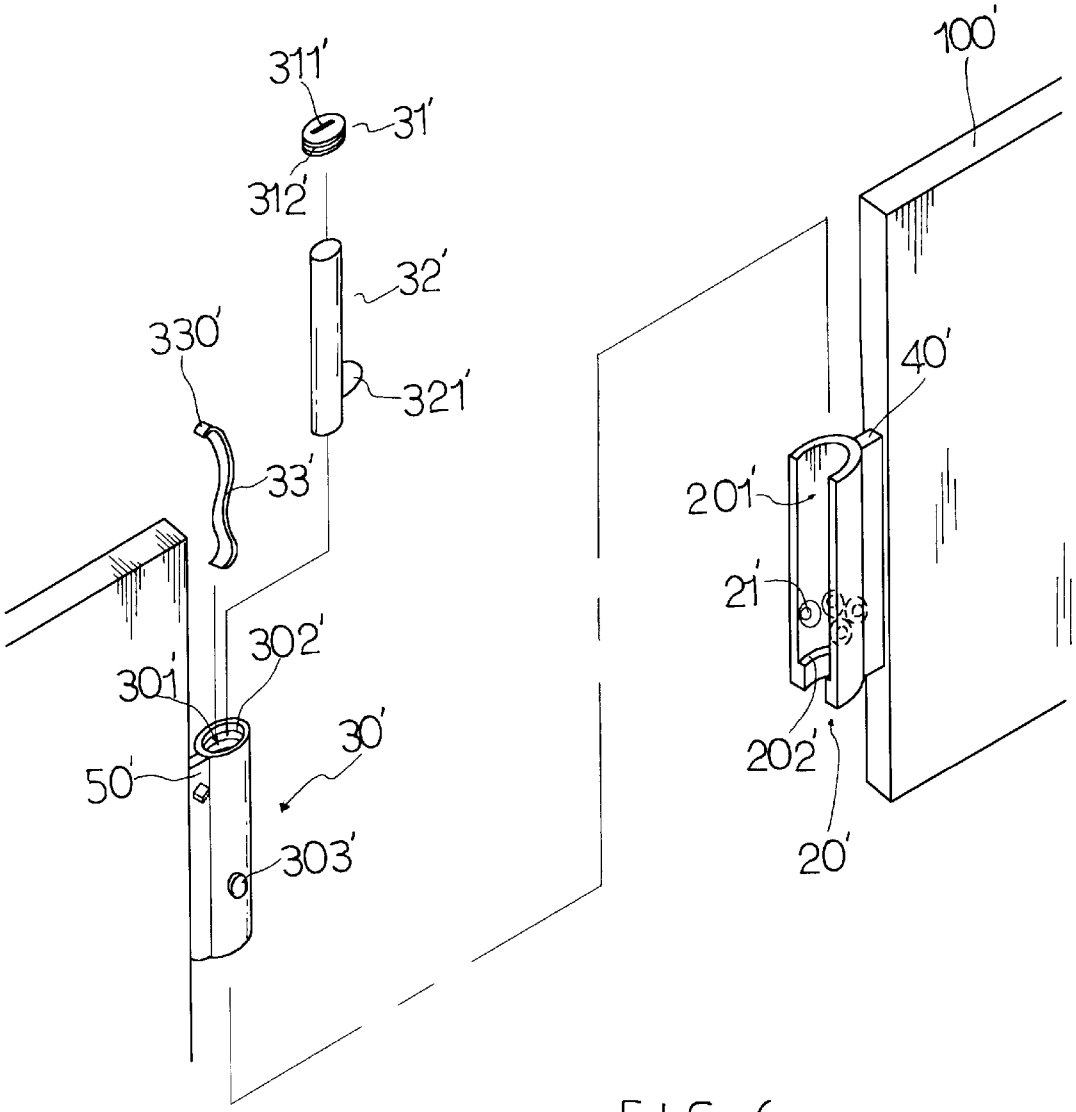
FIG. 6 is a partially perspective exploded view of a picture frame assembly of a second preferred embodiment in accordance with the present invention.
Figure 7:
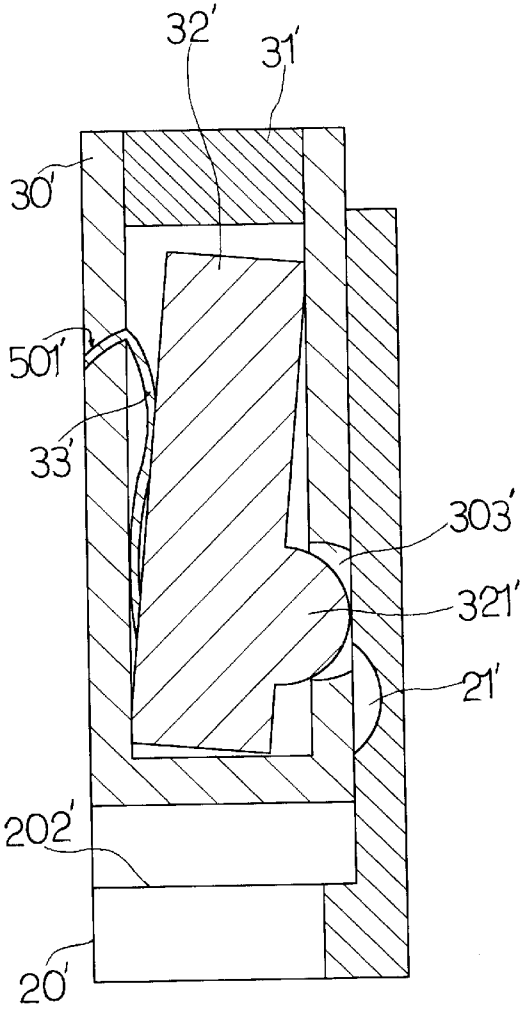
FIG. 7 is a sectional view of a picture frame assembly of a second preferred embodiment while two picture frames are assembled.
Figure 8:
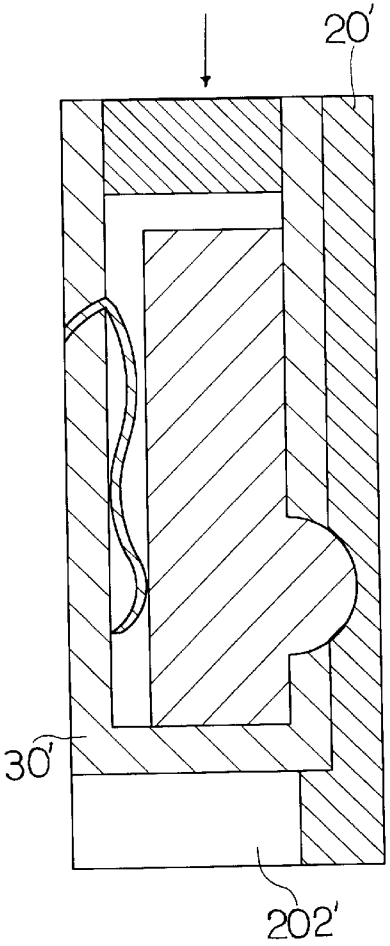
FIG. 8 is a sectional view of a picture frame assembly of a second preferred embodiment after two picture frames are assembled.

Referring to FIGS. 6 to 8, another picture frame 100' comprises a connection bar 50' disposed on a first lateral of the picture frame 100', a hollow insert rod 30' disposed on the connection bar 50', a connection plate 40' disposed on a second lateral of the picture frame 100', and a C-shaped clamp plate 20' disposed on the connection plate 40'.

The C-shaped clamp plate 20' has a channel 201', a C-shaped inner flange 202', and a plurality of spaced recesses 21' communicating with the channel 201'.

The connection bar 50' has a groove 501'.

The hollow insert rod 30' has a through hole 303' and an inner thread 302'. An elastic plate 33' has an upper curved end 330'. The elastic plate 33' is inserted in the hollow insert rod 30'. The upper curved end 330' is inserted in the groove 501'. A post 32' has a protrusion 321'. The post 32' is inserted in the hollow insert rod 30'. The protrusion 321' is inserted in the through hole 303'. The hollow insert rod 30' is inserted in the C-shaped clamp plate 20'. An upper cover 31' covers the hollow insert rod 30'. The upper cover 31' has a slot 311' and an outer thread 312' engaging with the inner thread 302' of the hollow insert rod 30'.

When the through hole 303' matches the respective recess 21' of the C-shaped clamp plate 20', the protrusion 321' is inserted in the respective recess 21'.

The user can use a bit of a screwdriver inserted in the slot 311' of the upper cover 31' in order to screw the upper cover 31' on the hollow insert rod 30'.

Therefore, the picture frame assembly of the present invention is easily assembled and detached.

The user can add more picture frames to the picture frame assembly. The picture frame assembly can be arranged in different ways so that the shape of the picture frame assembly can be various.

The present invention is not limited to the above embodiments but various modification thereof may be made. Furthermore, various changes in form and detail may be made without departing from the scope of the present invention.

I claim:

1. A picture frame assembly comprises:

a first picture frame and a second picture frame, the first picture frame having a first connection bar disposed on a first lateral of the first picture frame, a first insert rod disposed on the first connection bar, a first connection plate disposed on a second lateral of the first picture frame, and a first C-shaped clamp plate disposed on the first connection plate, the second picture frame having a second connection bar disposed on a first lateral of the second picture frame, a second insert rod disposed on the second connection bar, a second connection plate disposed on a second lateral of the second picture frame, and a second C-shaped clamp plate disposed on the second connection plate, the second insert rod of the second picture frame inserted in the first C-shaped clamp plate of the first picture frame, and each of the first and the second C-shaped clamp plates further having a channel and a plurality of spaced recesses communicating with the channel.

2. A picture frame assembly as claimed in claim 1, wherein each of the first and the second connection bars has a groove.

3. A picture frame assembly as claimed in claim 2, wherein the hollow insert rod has a through hole and an inner thread, an elastic plate has an upper curved end, the elastic plate is inserted in the hollow insert rod and the upper curved end is inserted in the groove, a post has a protrusion, the post is inserted in the hollow insert rod and the protrusion is inserted in the through hole, the hollow insert rod is inserted in the C-shaped clamp plate, and an upper cover covers the hollow insert rod.

4. A picture frame assembly as claimed in claim 3, wherein the upper cover has an outer thread engaging with the inner thread of the hollow insert rod.

* * * * *